US010135201B2

(12) United States Patent
Lai et al.

(10) Patent No.: US 10,135,201 B2
(45) Date of Patent: Nov. 20, 2018

(54) COVER BODY THAT FIXES A LIGHT GUIDE BAR AND ENHANCES THE STRUCTURAL STRENGTH OF THE COVERED CONNECTOR

(71) Applicant: GIGA-BYTE TECHNOLOGY CO., LTD., New Taipei (TW)

(72) Inventors: Chih-Ming Lai, New Taipei (TW); Yung-Shun Kao, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 6 days.

(21) Appl. No.: 15/605,934

(22) Filed: May 25, 2017

(65) Prior Publication Data

US 2018/0294606 A1 Oct. 11, 2018

(30) Foreign Application Priority Data

Apr. 6, 2017 (TW) ..... 106111498 A

(51) Int. Cl.
*H01R 13/717* (2006.01)
*H01R 12/71* (2011.01)

(52) U.S. Cl.
CPC ..... *H01R 13/7172* (2013.01); *H01R 12/716* (2013.01)

(58) Field of Classification Search
CPC ..... H01R 13/7172; H01R 12/716; H01R 13/717; H01R 13/7175
USPC ..... 439/488, 490, 607.13, 607.35, 607.54
See application file for complete search history.

(56) References Cited

U.S. PATENT DOCUMENTS

| | | | | |
|---|---|---|---|---|
| 5,797,767 | A | 8/1998 | Schell | |
| 5,876,239 | A * | 3/1999 | Morin | H01R 13/717 439/490 |
| 7,249,966 | B2 * | 7/2007 | Long | H01R 13/65802 439/490 |
| 8,335,416 | B2 * | 12/2012 | Shirk | G02B 6/0008 385/146 |
| 8,823,540 | B2 * | 9/2014 | Scholeno | H01R 12/716 340/815.4 |
| 9,612,391 | B2 * | 4/2017 | Wu | G02B 6/0075 |
| 9,780,512 | B2 * | 10/2017 | Hsu | H01R 33/97 |

(Continued)

FOREIGN PATENT DOCUMENTS

| | | |
|---|---|---|
| TW | 565023 | 12/2003 |
| TW | M418473 | 12/2011 |
| TW | M522482 | 5/2016 |

OTHER PUBLICATIONS

"Office Action of Taiwan Counterpart Application," dated Apr. 24, 2018, pp. 1-4.

*Primary Examiner* — Tulsidas C Patel
*Assistant Examiner* — Travis Chambers
(74) *Attorney, Agent, or Firm* — JCIPRNET

(57) ABSTRACT

A connector cover module adapted to be disposed on a connector on a mother board is provided. The connector cover module includes a cover body and at least one light guide bar. The cover body includes a top surface, a plurality of lateral surfaces, and at least one arm extending from one of the lateral surfaces and bending outward to form an accommodating groove. The light guide bar is disposed beside one of the lateral surfaces, held by the arms, and located in the accommodating groove bent and formed by the arms. A cover body is further provided.

16 Claims, 9 Drawing Sheets

(56) References Cited

U.S. PATENT DOCUMENTS

| | | | | |
|---|---|---|---|---|
| 2007/0253168 | A1* | 11/2007 | Miller | G02B 6/4246<br>361/719 |
| 2013/0189876 | A1 | 7/2013 | Lang et al. | |
| 2015/0318643 | A1* | 11/2015 | Lane | H01R 12/716<br>439/607.35 |

* cited by examiner

COVER BODY THAT FIXES A LIGHT GUIDE BAR AND ENHANCES THE STRUCTURAL STRENGTH OF THE COVERED CONNECTOR

CROSS-REFERENCE TO RELATED APPLICATION

This application claims the priority benefit of Taiwan application serial no. 106111498, filed on Apr. 6, 2017. The entirety of the above-mentioned patent application is hereby incorporated by reference herein and made a part of this specification.

BACKGROUND OF THE INVENTION

[Field of the Invention]

The invention relates to a cover module and a cover body, and in particular, a connector cover module and a cover body.

[Description of Related Art]

As technology advances, users' demands are becoming more and more diversified. To enable a mother board to provide effects such as light indication, a light source such as an LED is disposed on the mother board. However, a wiring area on the mother board is limited, and it is not always possible to dispose the LED wherever light emission is desired. One of the goals to explore in the field is how to dispose a structure providing light emission in a large area at specific positions (e.g., beside a connector) on the mother board. Moreover, currently for certain connectors (a PCI-E connector, for example) on the mother board, since the inserted expansion card may be disposed with a fan or other components on one side and may be unevenly weighted, the connectors may crack easily.

SUMMARY OF THE INVENTION

The invention provides a connector cover module that functions with one or more LEDs for light transmission in a large area and enhances structural strength of a covered connector.

The invention provides a cover body that fixes a light guide bar to enable the light guide bar to transmit light in a large area and enhances the structural strength of the covered connector.

The invention provides a connector cover module adapted to be disposed on a connector on a mother board. The connector cover module includes a cover body and at least one light guide bar. The cover body includes a top surface, a plurality of lateral surfaces, and at least one arm, wherein the at least one aim extends from one of the lateral surfaces and bends outward to form an accommodating groove. The light guide bar is located beside one of the lateral surfaces, held by the corresponding arms, and located in the accommodating groove bent and formed by the arms.

In an embodiment of the invention, the at least one arm includes a plurality of the arms. The arms are respectively located on two opposite sides of one of the lateral surfaces and correspond to each other. The arms respectively extend toward an opposite direction to collectively bend and form the accommodating groove.

In an embodiment of the invention, the at least one arm includes a plurality of the arms. The arms are respectively located on two opposite sides of one of the lateral surfaces and are misaligned from each other. The arms respectively extend toward an opposite direction to collectively bend and form the accommodating groove.

In an embodiment of the invention, the at least one arm includes a plurality of the arms. The arms are aligned on an edge of one of the lateral surfaces in a length direction and extend in a same direction to collectively bend and form the accommodating groove.

In an embodiment of the invention, the at least one arm includes a plurality of the arms. The arms respectively protrude from two opposite lateral surfaces of the lateral surfaces and bend and form two accommodating grooves located outside the two lateral surfaces. The at least one light guide bar includes two light guide bars. The two light guide bars are held by the arms and are located in the two accommodating grooves.

In an embodiment of the invention, the light guide bar is in a plate shape and has a greater length in two opposite lateral surfaces of the lateral surfaces. One lateral surface of the light guide bar having a greater length is only covered by the arm, when the light guide bar is located in the accommodating groove.

In an embodiment of the invention, each of the arms includes a first fixing part. Each of the light guide bars includes a second fixing part corresponding to the first fixing part. One of the first fixing part and the second fixing part is a recess or a through-hole, and the other one is a bending elastic piece or a bump.

In an embodiment of the invention, the cover body includes a fixing leg extending from one of the lateral surfaces to a direction away from the top surface, and the fixing leg is adapted to be fixed to the mother board.

In an embodiment of the invention, the cover body includes a bending leg that is located on an edge of one of the lateral surfaces away from the top surface and is adapted to bend to below a bottom surface of the connector.

In an embodiment of the invention, each of the light guide bars includes an inclined light incident part adapted to be adjacently disposed beside a light source of the mother board such that light emitted by the light source enters the light guide bar via the light incident part.

The invention provides a cover body of the above-described connector cover module.

In light of the above, in the connector cover module of the invention, the arms extending from the lateral surface bend to form the accommodating groove to accommodate and hold the light guide bar. Since only a small portion of the light guide bar is covered by the arms and the other portions are exposed, the effect of transmitting light in a large area is achieved. Moreover, the cover body of the connector cover module of the invention is disposed on the connector, which effectively enhances the structural strength of the connector. Furthermore, since part of the connectors are aligned on the mother board, if the plurality of the connector cover modules are disposed on the connectors, the light guide bars disposed beside the lateral surfaces of the cover body fill in between the adjacent connectors, which also enhances the strength of the connectors and reduces the rate of cracking of the connectors.

To provide a further understanding of the aforementioned and other features and advantages of the invention, exemplary embodiments, together with the reference drawings, are described in detail below.

DESCRIPTION OF THE EMBODIMENTS

Figure 1:
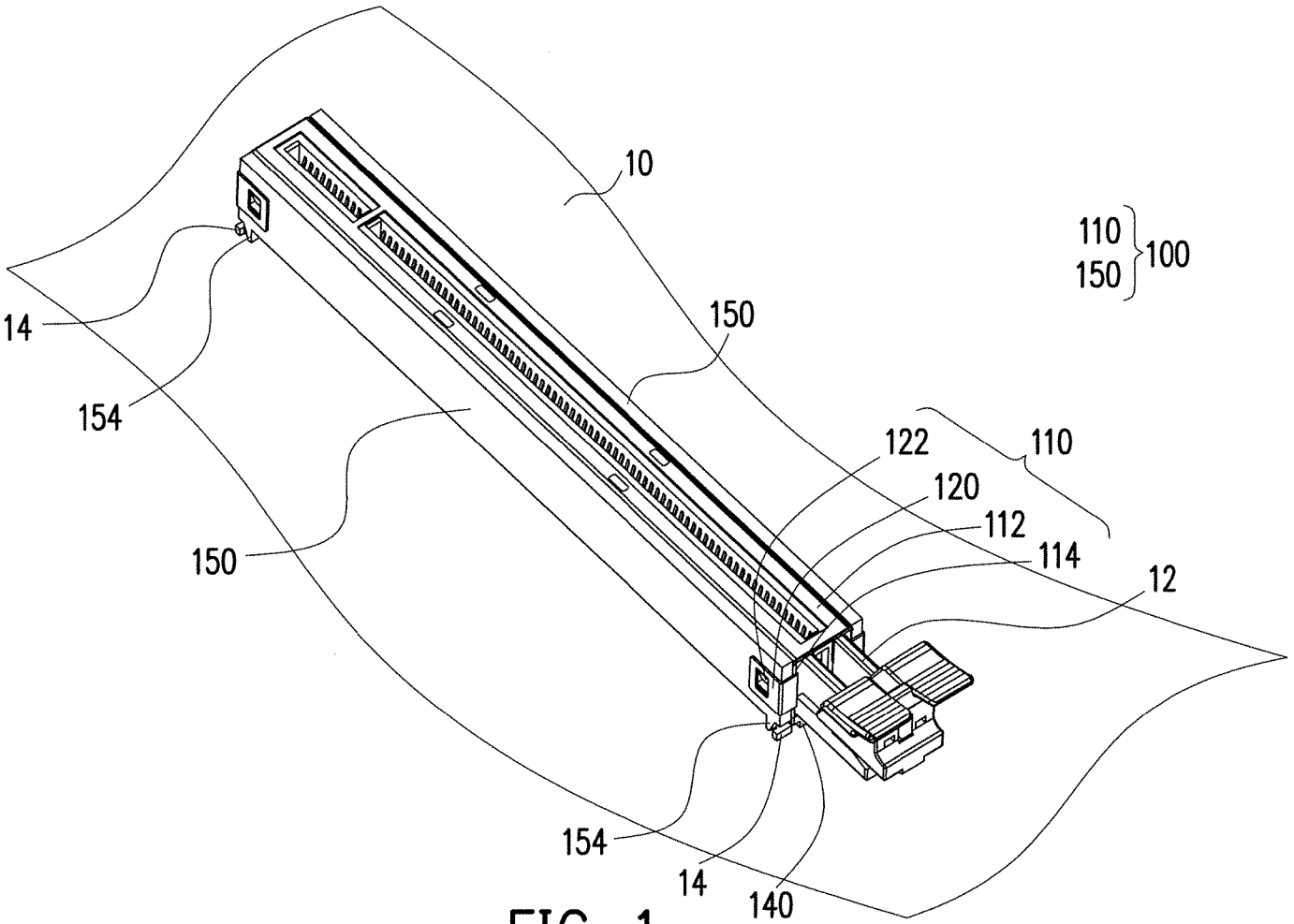
FIG. 1 is a schematic diagram illustrating a connector cover module disposed on a connector according to an embodiment of the invention.
Figure 2:
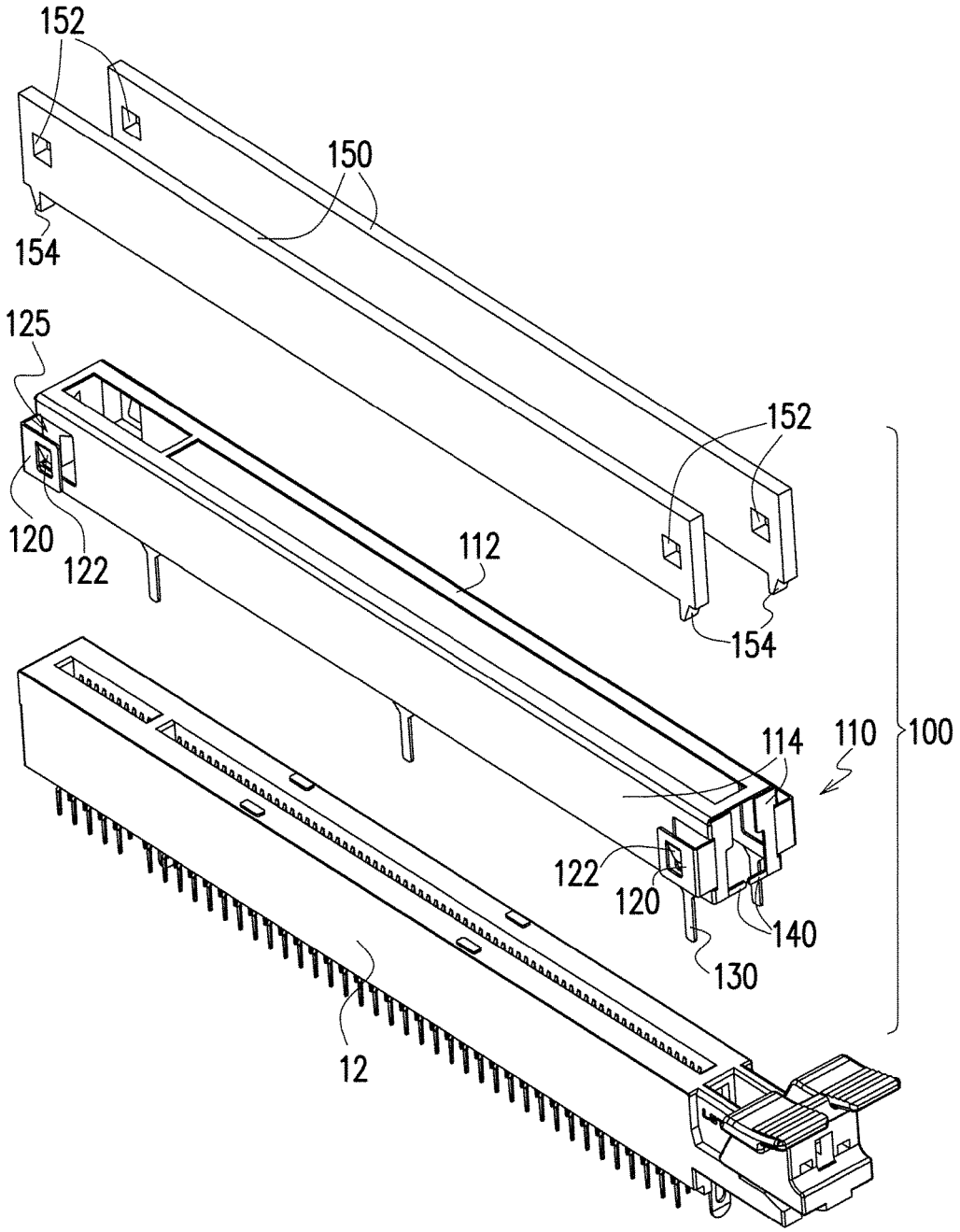
FIG. 2 is an exploded schematic diagram illustrating the connector cover module and the connector of FIG. 1.
Figure 3:
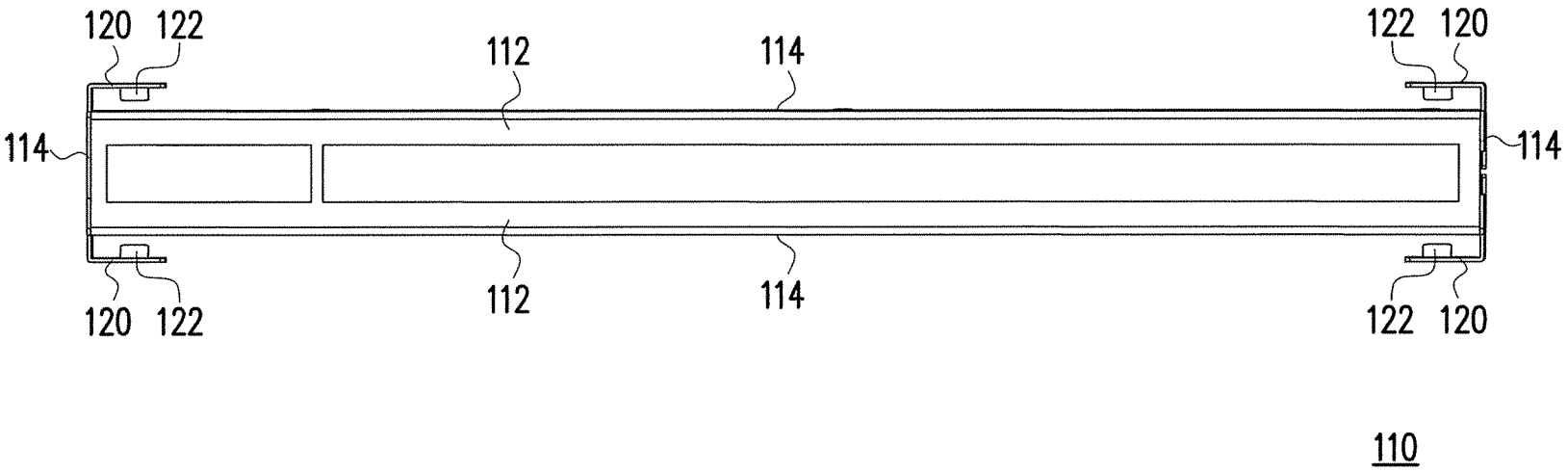
FIG. 3 is a top schematic diagram illustrating a cover body of the connector cover module of FIG. 1.
Figure 4:
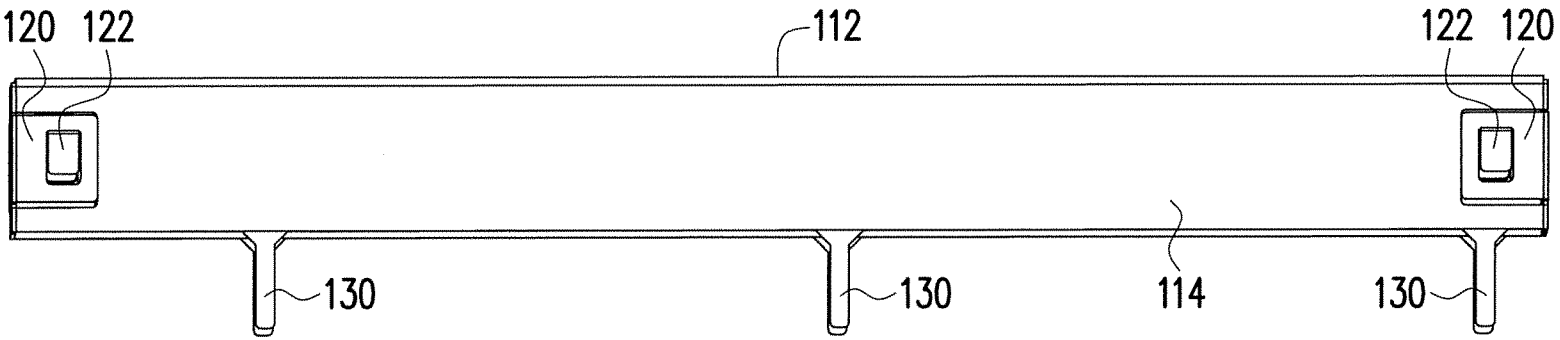
FIG. 4 is a side schematic diagram illustrating the cover body of the connector cover module of FIG. 1.

FIG. 1 is a schematic diagram illustrating a connector cover module disposed on a connector according to an embodiment of the invention. FIG. 2 is an exploded schematic diagram illustrating the connector cover module and the connector of FIG. 1. FIG. 3 is a top schematic diagram illustrating a cover body of the connector cover module of FIG. 1. FIG. 4 is a side schematic diagram illustrating the cover body of the connector cover module of FIG. 1.

Referring to FIG. 1 first, a connector cover module 100 of the present embodiment is adapted to be disposed on a connector 12 located on a mother board 10. In the present embodiment, the connector 12 is, for example, a PCI-E connector 12. However, the type of the connector 12 is not limited hereto. The connector cover module 100 of the present embodiment provides a light guide bar 150 that is light-transmitting in a large area on at least one side beside the connector 12 to provide a large-area light-emitting indication or esthetic effect on the condition that the light guide bar 150 is securely fixed.

Referring to FIG. 1 to FIG. 4, the connector cover module 100 of the present embodiment includes a cover body 110 and at least one light guide bar 150. The cover body 110 includes a top surface 112, a plurality of lateral surfaces 114, and at least one arm 120, wherein each arm 120 extends from one of the lateral surfaces 114 and bends outward to form an accommodating groove 125. As FIG. 2 shows, in the present embodiment, the cover body 110 includes four lateral surfaces 114, wherein two opposite lateral surfaces 114 have a greater length, and the other two opposite lateral surfaces 114 have a smaller length. Moreover, the cover body 110 includes four arms 120. The four arms 120 respectively extend from the two lateral surfaces 114 having the smaller length and turn to extend in a direction parallel with the lateral surfaces 114 having the greater length, such that each aim 120 is in an L shape.

In other words, as FIG. 3 shows, the four arms 120 respectively protrude from the two lateral surfaces 114 having the greater length and bend to form two accommodating grooves 125 outside the two lateral surfaces 114. In addition, as FIG. 4 shows, the two arms 120 beside the same lateral surface 114 are respectively located on two opposite sides of the lateral surface 114 and correspond to each other, and extend toward an opposite direction to collectively bend and form the accommodating grooves 125 (labeled in FIG. 2).

Referring to FIG. 1 again, in the present embodiment, the light guide bar 150 is in a plate shape, and a dimension of the light guide bar 150 approximates a dimension of the lateral surface 114 adjacent to it. However, the shape and the dimension of the light guide bar 150 are not limited hereto. The connector cover module 100 includes two light guide bars 150. The two light guide bars 150 are respectively located outside the two opposite lateral surfaces 114 and are located in the two accommodating grooves 125 bent by the arms 120.

As FIG. 1 clearly shows, the two arms 120 beside the same lateral surface 114 are respectively located on the two opposite sides of the lateral surface 114 and extend toward a direction of each other (i.e., a left or right direction). Therefore, when the light guide bar 150 is located in the accommodating groove 125, the light guide bar 150 is confined in the left and right directions by the arms 120 on the two sides. In other words, the light guide bar 150 is unable to move in the left and right directions relative to the cover body 110. Moreover, the light guide bar 150 is also confined in forward and backward directions by the arms 120 and the lateral surface 114 and is unable to move in the forward and backward directions relative to the cover body 110.

In addition, as FIG. 2 shows, in the present embodiment, each arm 120 includes a first fixing part 122, and each light guide bar 150 includes a second fixing part 152 corresponding to the first fixing part 122. More specifically, in the present embodiment, the first fixing part 122 is a bending elastic piece, and the second fixing part 152 is a through-hole. In the present embodiment, the first fixing part 122 is connected to the arm 120 on an upper side and is suspending on a lower side. Moreover, the first fixing part 122 bends toward the lateral surface 114. When the light guide bar 150 is assembled to the cover body 110, one only needs to insert the light guide bar 150 downward from above into the accommodating groove 125, and the first fixing part 122 is first pushed by light guide bar 150 outward in a direction away from the lateral surface 114. As the second fixing part 152 of the light guide bar 150 moves to a position corresponding to the first fixing part 122 of the arm 120, the first fixing part 122 of the arm 120 restores its original configuration, reaches into the second fixing part 152, and fits against an inner wall of the through-hole so as to fix the light guide bar 150 to the cover body 110 in at least one direction.

In the present embodiment, the first fixing part 122 reaches into the second fixing part 152 and leans against a lower wall of the through-hole. Therefore, the light guide bar 150 is held by the corresponding arms 120 and does not move upward relative to the cover body 110. Moreover, the first fixing part 122 is also confined by left and right walls of the through-hole and does not move leftward or rightward relative to the cover body 110. In addition, as FIG. 1 shows, the connector cover module 100 rests on the mother board 10. Therefore, the light guide bar 150 and the cover body 110 are both supported by the mother board 10. The light guide bar 150 is unable to move downward relative to the cover body 110.

In other words, in the present embodiment, the light guide bar 150 is confined in all of the upward, downward, leftward, rightward, forward, and backward directions relative to the cover body 110, such that the light guide bar 150 is securely fixed on the cover body 110. Of course, the types of the first fixing part 122 and the second fixing part 152 are not limited hereto. In other embodiments, one of the first fixing part 122 and the second fixing part 152 is a recess or a through-hole, and the other is a bending elastic piece or a bump, as long as the two components can fix together.

In the present embodiment, the accommodating groove 125 used to accommodate the light guide bar 150 is formed by bending the arms 120 and confines the light guide bar 150 by the arms 120 so that the light guide bar 150 does not move leftward, rightward, forward, backward, and upward. An area of the arm 120 is small; as FIG. 4 shows, a projection area of the arm 120 on the lateral surface 114 having the greater length is only a small portion of an area of the lateral surface 114 (e.g., less than 10% of the area of the lateral surface 114). Therefore, when the light guide bar 150 is located in the accommodating groove 125, a lateral surface of the light guide bar 150 having the second fixing part 152 is only covered by the arm 120 and, as FIG. 1 shows, most of the area is exposed. In other words, the light guide bar 150 of the connector cover module 100 of the present embodiment is light-transmitting in a large area.

In the present embodiment, each light guide bar 150 includes at least one light incident part 154, which is inclined. As FIG. 1 shows, each light guide bar 150 includes two inclined light incident parts 154 respectively at a bottom close to the two sides. The two light incident parts 154 are respectively located beside two light sources 14 of the mother board 10, such that light emitted by the light sources 14 enters the light guide bar 150 via the light incident parts 154, and light is emitted from the light guide bar 150 in a large area. The inclined light incident parts 154 increase a light incident area and effectively guide in more light. In the present embodiment, the light source 14 is, for example, an LED. However, the type of the light source 14 is not limited hereto.

As FIG. 2 shows, the cover body 110 includes at least one fixing leg 130 extending from one of the lateral surfaces 114 to a direction away from the top surface 112. The fixing leg 130 is adapted to be fixed to the mother board 10. In the present embodiment, the cover body 110 includes six fixing legs 130. However, the number of the fixing legs 130 is not limited hereto. In the present embodiment, the fixing leg 130 is fixed to the mother board 10 through reflow soldering. The fixing leg 130 may be further connected to a grounding end of the mother board 10 to provide a flow path for static electricity. Since the light guide bar 150 of the present embodiment is assembled to the cover body 110 after the cover body 110 is assembled on the connector 12 and fixed to the mother board 10, the light guide bar 150 is not subject to a high temperature of reflow soldering, which effectively avoids lowering light-guiding effect of the light guide bar 150 resulting from the influence of the high temperature. Therefore, excellent light-guiding quality of the light guide bar 150 can be maintained.

In addition, in the present embodiment, as FIG. 2 shows, the cover body 110 includes at least one bending leg 140 that is located on an edge of one of the lateral surfaces 114 having the smaller length away from the top surface 112 and bends inward to be adapted to, as FIG. 1 shows, fit with a bottom surface of the connector 12 close to a manipulation part on the right side. In the present embodiment, the cover body 110 is, for example, a metal piece. Before the cover body 110 is disposed on the connector 12, the bending leg 140 is not bent yet and extends along a direction parallel with the lateral surface 114 having the greater length, to allow the cover body 110 to be disposed downward on the connector 12. After the cover body 110 is disposed on the connector 12, an operator bends the bending leg 140 such that the bending leg 140, as FIG. 1 and FIG. 2 show, extends along a direction parallel with the lateral surface 114 having the smaller length. At a position below a bottom surface of the connector 12 close to the manipulation part on the right side, the bending leg 140 is hooked with the connector 12, so that the cover body 110 does not move upward relative to the connector 12 and the two components are fixed to each other. Similarly, the top surface 112 and the four lateral surfaces 114 of the cover body 110 cover a top surface and four sides of the connector 12 and confine the cover body 110 such that the cover body 110 does not move forward, backward, leftward, rightward, and downward relative to the connector 12. Moreover, the cover body 110 is further fixed to the mother board 10 by the fixing leg 130 and is securely fixed to the connector 12.

It shall be noted that the position of the arm 120 of the cover body 110 is not limited to that in the present embodiment. Other configurations of the arm 120 are described below. FIG. 5 to FIG. 8 are respectively side schematic diagrams illustrating cover bodies of various connector cover modules according to a plurality of embodiments of the invention. It shall be noted that, in the following embodiments, components identical or similar to those in the previous embodiment are labeled by the same or similar reference numerals. Only main differences from the previous embodiment are described, and the identical content is not repeatedly described.

Figure 5:
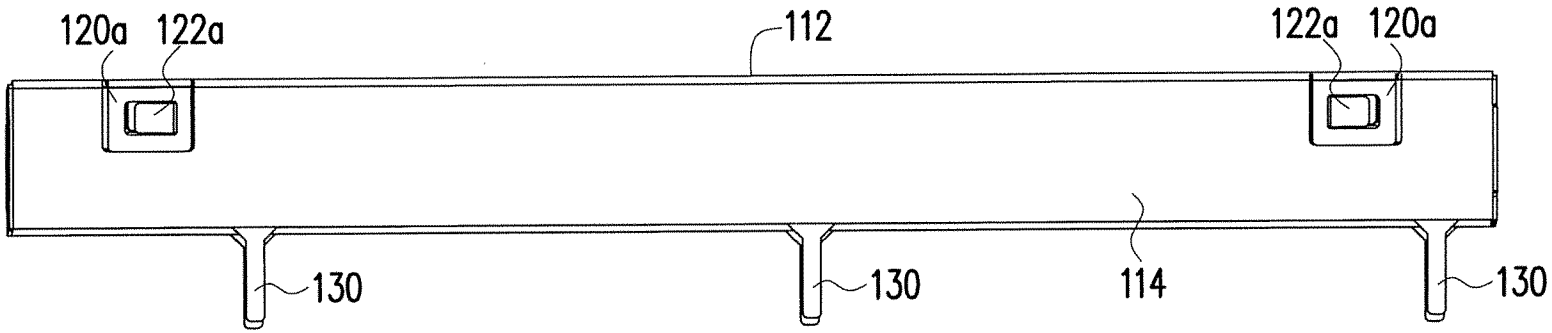
FIG. 5 to FIG. 8 are respectively side schematic diagrams illustrating cover bodies of various connector cover modules according to a plurality of embodiments of the invention.

Referring to FIG. 5 first, in the present embodiment, arms 120*a* are aligned on an edge of one of the lateral surfaces 114 in a length direction and extend in the same direction to collectively bend and form the accommodating groove 125 (marked in FIG. 2). More specifically, as FIG. 5 shows, in the lateral surface 114, the two arms 120*a* are aligned on an upper edge of the lateral surface 114 and extend downward. In the present embodiment, the alms 120*a* confine upward movement and movement in the forward and backward directions of the light guide bar 150 (illustrated in FIG. 2). Two first fixing parts 122*a* of the two arms 120*a* reach into the through-holes of the light guide bar 150 and lean against the inner wall of the through-holes. The first fixing part 122*a* on the left side confines the rightward movement and upward/downward movement of the light guide bar 150, and the first fixing part 122*a* on the right side confines the leftward movement and upward/downward movement of the light guide bar 150. Moreover, the mother board 10 (illustrated in FIG. 1) confines the downward movement of the light guide bar 150 and fixes the light guide bar 150.

Figure 6:
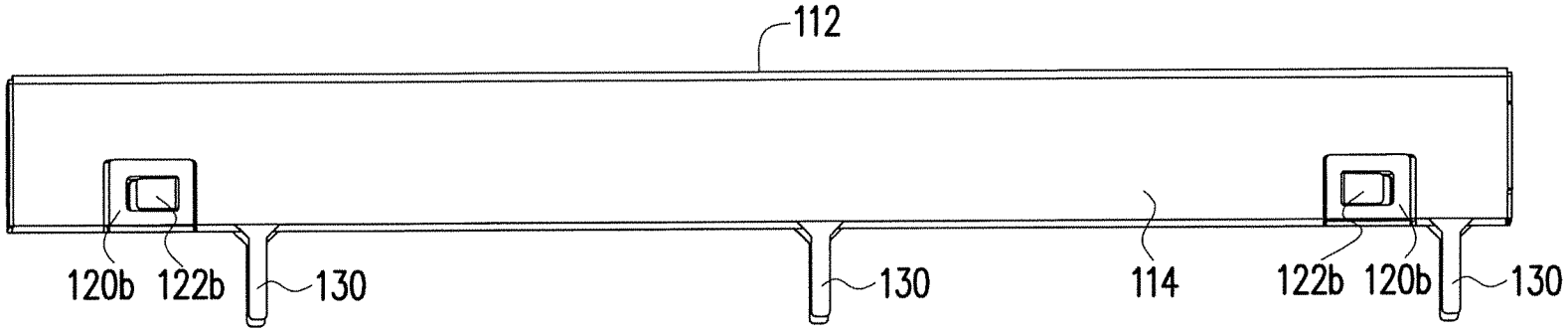

Referring to FIG. 6, in the present embodiment, two arms 120*b* are aligned on a lower edge of the lateral surface 114 and extend upward. Similarly, in the present embodiment, the arms 120*b* confine the downward movement and movement in the forward and backward directions of the light guide bar 150 (illustrated in FIG. 2). Two first fixing parts 122*b* of the two arms 120*b* reach into the through-holes of the light guide bar 150 and lean against the inner wall of the through-holes. The first fixing part 122*b* on the left side confines the rightward movement and upward/downward movement of the light guide bar 150. The first fixing part 122*b* on the right side confines the leftward movement and upward/downward movement of the light guide bar 150. Moreover, the mother board 10 (illustrated in FIG. 1) confines the downward movement of the light guide bar 150 and fixes the light guide bar 150.

Figure 7:
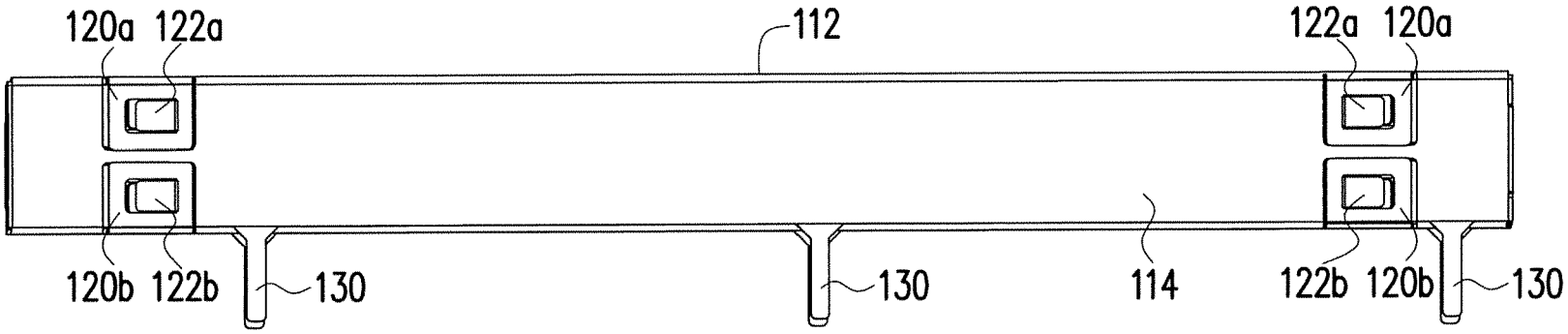

Referring to FIG. 7, in the present embodiment, the two arms 120*a* are aligned on the upper edge of the lateral surface 114 and extend downward. The other two arms 120*b* are aligned on the lower edge of the lateral surface 114 and extend upward. Similarly, they achieve the effect of confining the upward/downward, leftward/rightward, and forward/backward movement of the light guide bar 150.

Figure 8:
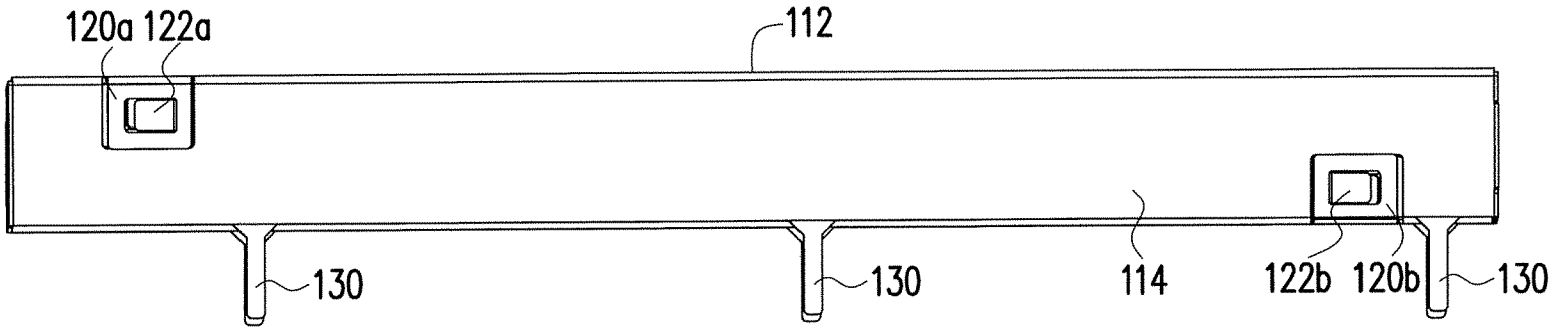

Referring to FIG. 8, in the present embodiment, the two arms 120*a*, 120*b* are respectively located on the two opposite sides of the lateral surface 114 and are misaligned from each other. The arms 120*a*, 120*b* respectively extend toward the opposite direction and collectively bend to form the accommodating groove 125. Specifically, the one arm 120*a* is located on the upper edge of the lateral surface 114 and extends downward. The other arm 120*b* is located on the lower edge of the lateral surface 114 and extends upward. Moreover, the two arms 120*a*, 120*b* are misaligned. Such configuration similarly achieves the effect of confining the upward/downward, leftward/rightward, and forward/backward movement of the light guide bar 150.

It shall be mentioned that, in the embodiment of FIG. 1, the arms 120 are symmetrically located on the two opposite lateral surfaces 114 having the greater length. In other words, in the two opposite lateral surfaces 114 having the greater length, the configuration of the arms 120 on each lateral surface 114 is all identical to the configuration in FIG. 4. However, in other embodiments, in the two opposite lateral surfaces 114 having the greater length, different arms 120, 120*a*, 120*b* may be disposed. For example, in one of the lateral surfaces 114 having the greater length, the configuration of FIG. 5 may be adopted to dispose the arms 120*a*. In the other lateral surface 114 having the greater length, the configuration of FIG. 6 may be adopted to dispose the arms 120*b*. Alternatively, in one of the lateral surfaces 114 having the greater length, the configuration of FIG. 8 (i.e., upper-left and lower-right) may be adopted to dispose the arms 120*a*, 120*b*, and in the other lateral surface 114 having the greater length, a configuration reverse to that of FIG. 8 (i.e., upper-right and lower-left) may be adopted to dispose the arms 120*a*, 120*b*. The configuration is not limited to the description above.

Figure 9:
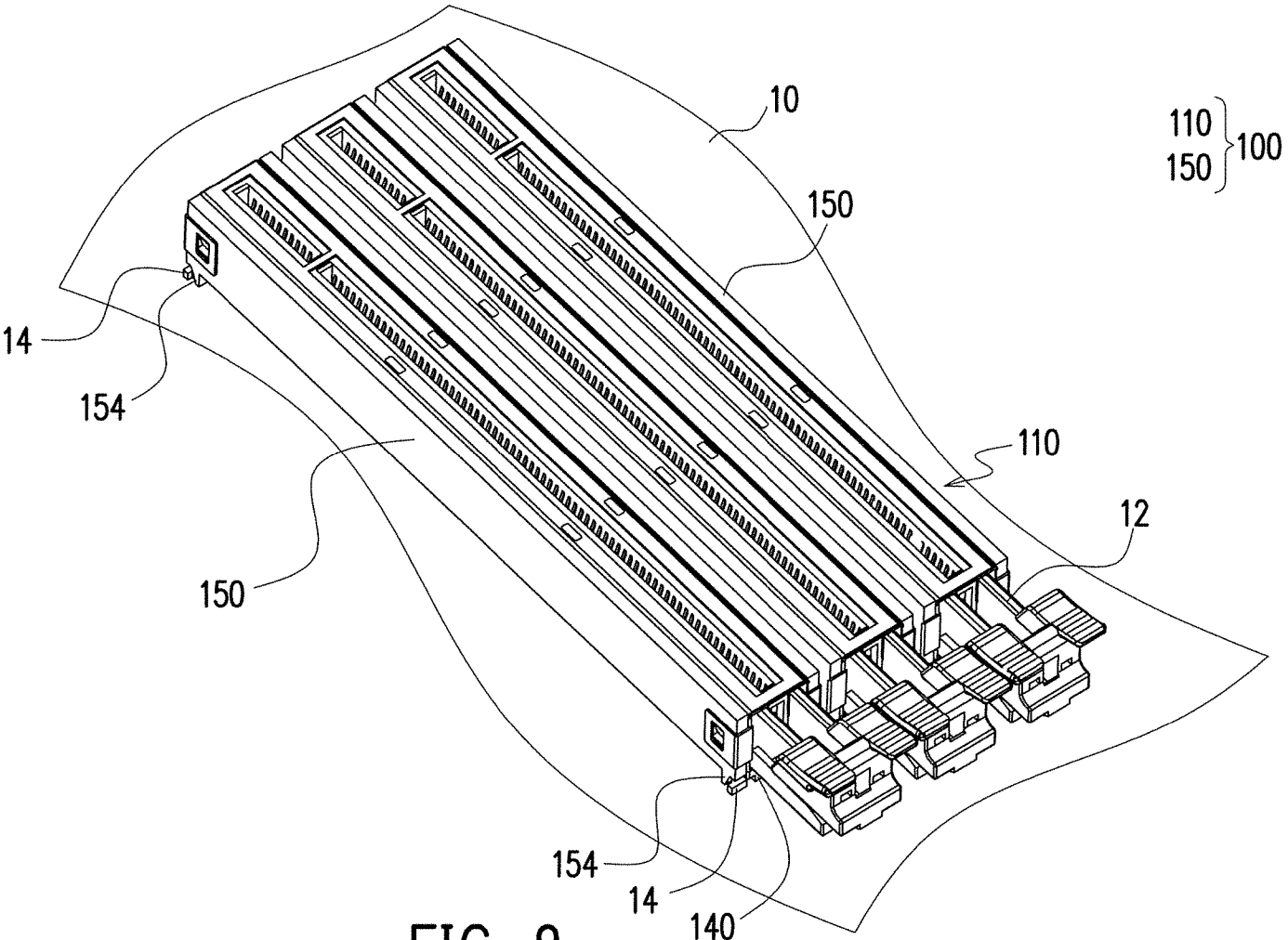
FIG. 9 is a schematic diagram illustrating a plurality of the connector cover modules and the connectors of FIG. 1.

FIG. 9 is a schematic diagram illustrating a plurality of the connector cover modules and the connectors of FIG. 1. Referring to FIG. 9, FIG. 9 illustrates a plurality of the connector cover modules 100. Since the PCI-E connectors 12 on the mother board 10 are in an aligned configuration, a designer may fill the light guide bar 150 of the connector cover module 100 in between two adjacent connectors 12. Accordingly, in the connector cover module 100, the strength of the connector 12 is, on the one hand, enhanced through the cover body 110 of the metal material. On the other hand, since the two adjacent connectors 12 are filled in with the light guide bar 150, the light guide bar 150 provides light indication or esthetic effect. Moreover, if the connector 12 is inserted into an expansion card which is disposed with a fan on one side and is unevenly weighted, the light guide bar 150 disposed beside the connector 12 provides support against a cracking direction and reduces a rate of cracking of the connector 12.

In summary of the above, in the connector cover module of the invention, the arms extending from the lateral surface bend to form the accommodating groove to accommodate and hold the light guide bar. Since only a small portion of the light guide bar is covered by the arms and the other portions are exposed, the effect of transmitting light in a large area is achieved. Moreover, the cover body of the connector cover module of the invention is disposed on the connector, which effectively enhances the structural strength of the connector. Furthermore, since part of the connectors are aligned on the mother board, if a plurality of the connector cover modules are disposed on the connectors, the light guide bars disposed beside the lateral surfaces of the cover body fill in between the adjacent connectors, which also enhances the strength of the connectors and reduces the rate of cracking of the connectors.

Although the invention is disclosed as the embodiments above, the embodiments are not meant to limit the invention. Any person skilled in the art may make slight modifications and variations without departing from the spirit and scope of the invention. Therefore, the protection scope of the invention shall be defined by the claims attached below.

What is claimed is:

1. A connector cover module adapted to be disposed on a connector on a mother board, the connector cover module comprising:

a cover body comprising a top surface, a plurality of lateral surfaces, a fixing leg, and at least one arm, wherein the fixing leg extending from one of the lateral surfaces to a direction away from the top surface, the fixing leg is adapted to be fixed to the mother board, and the at least one arm extends from one of the lateral surfaces and bends outward to form an accommodating groove; and at least one light guide bar located beside one of the lateral surfaces, held by the corresponding at least one arm, and located in the accommodating groove bent and formed by the at least one arm.

2. The connector cover module according to claim 1, wherein the at least one arm comprises a plurality of the arms, the arms are respectively located on two opposite sides of one of the lateral surfaces and correspond to each other, and the arms respectively extend toward an opposite direction to collectively bend and form the accommodating groove.

3. The connector cover module according to claim 1, wherein the at least one arm comprises a plurality of the arms, the arms are respectively located on two opposite sides of one of the lateral surfaces and are misaligned from each other, and the arms respectively extend toward an opposite direction to collectively bend and form the accommodating groove.

4. The connector cover module according to claim 1, wherein the at least one arm comprises a plurality of the arms, and the arms are aligned on an edge of one of the lateral surfaces in a length direction and extend in a same direction to collectively bend and form the accommodating groove.

5. The connector cover module according to claim 1, wherein the at least one arm comprises a plurality of the arms, and the arms respectively protrude from two opposite lateral surfaces of the lateral surfaces and bend and form two accommodating grooves located outside the two lateral surfaces, wherein the at least one light guide bar comprises two light guide bars, and the two light guide bars are held by the arms and are located in the two accommodating grooves.

6. The connector cover module according to claim 1, wherein the cover body comprises a bending leg that is located on an edge of one of the lateral surfaces away from the top surface and is adapted to bend to below a bottom surface of the connector.

7. The connector cover module according to claim 1, wherein each of the light guide bars is in a plate shape and has a greater length in two opposite lateral surfaces of the lateral surfaces, wherein one of the lateral surfaces of the light guide bar having a greater length is only covered by the arm, when the light guide bar is located in the accommodating groove.

8. The connector cover module according to claim 1, wherein each of the arms comprises a first fixing part, and each of the light guide bars comprises a second fixing part corresponding to the first fixing part, wherein one of the first fixing part and the second fixing part is a recess or a through-hole, and the other one is a bending elastic piece or a bump.

9. The connector cover module according to claim 1, wherein each of the light guide bars comprises an inclined light incident part adapted to be adjacently disposed beside a light source of the mother board such that light emitted by the light source enters the light guide bar via the light incident part.

10. A cover body of connector cover module, comprising:

a top surface;

a plurality of lateral surfaces, connected to the top surface;

a fixing leg, extending from one of the lateral surfaces to a direction away from the top surface, the fixing leg is adapted to be fixed to the mother board;

a bending leg, located on an edge of one of the lateral surfaces away from the top surface and is configured to bend to below a bottom surface of a connector; and at least one arm, extending from one of the lateral surfaces and bends outward to form an accommodating groove.

11. The cover body according to claim 10, wherein the at least one arm comprises a plurality of the arms, the arms are respectively located on two opposite sides of one of the lateral surfaces and correspond to each other, and the arms respectively extend toward an opposite direction to collectively bend and form the accommodating groove.

12. The cover body according to claim 10, wherein the at least one arm comprises a plurality of the arms, the arms are respectively located on two opposite sides of one of the lateral surfaces and are misaligned from each other, and the arms respectively extend toward an opposite direction to collectively bend and form the accommodating groove.

13. The cover body according to claim 10, wherein the at least one arm comprises a plurality of the arms, and the arms are aligned on an edge of one of the lateral surfaces in a length direction and extend in a same direction to collectively bend and form the accommodating groove.

14. The cover body according to claim 10, wherein the at least one arm comprises a plurality of the arms, and the arms respectively protrude from two opposite lateral surfaces of the lateral surfaces and bend and form two accommodating grooves located outside the two lateral surfaces, wherein two light guide bars are adapted to be held by the arms and are located in the two accommodating grooves.

15. The cover body according to claim 10, wherein a light guide bar is adapted to be held by the at least one arm and located in the accommodating groove, the light guide bar is in a plate shape and has a greater length in two opposite lateral surfaces of the lateral surfaces, wherein one of the lateral surfaces of the light guide bar having a greater length is only covered by the arm, when the light guide bar is located in the accommodating groove.

16. The cover body according to claim 10, wherein each of the arms comprises a first fixing part, and a light guide bar comprises a second fixing part corresponding to the first fixing part, wherein one of the first fixing part and the second fixing part is a recess or a through-hole, and the other one is a bending elastic piece or a bump.

* * * * *